US010316791B2

(12) United States Patent
Dobua et al.

(10) Patent No.: US 10,316,791 B2
(45) Date of Patent: Jun. 11, 2019

(54) PISTON FOR AN INTERNAL COMBUSTION ENGINE WITH A SHAFT

(71) Applicant: Mahle International GmbH, Stuttgart (DE)

(72) Inventors: Cedric Dobua, Stuttgart (DE); Zeynep Kara, Stuttgart (DE)

(73) Assignee: Mahle International GmbH (DE)

( * ) Notice: Subject to any disclaimer, the term of this patent is extended or adjusted under 35 U.S.C. 154(b) by 0 days.

(21) Appl. No.: 15/585,141

(22) Filed: May 2, 2017

(65) Prior Publication Data

US 2017/0321626 A1 Nov. 9, 2017

(30) Foreign Application Priority Data

May 3, 2016 (DE) ..... 10 2016 207 592

(51) Int. Cl.
*F02F 3/10* (2006.01)
*B05D 7/00* (2006.01)

(52) U.S. Cl.
CPC ..... *F02F 3/10* (2013.01); *B05D 7/544* (2013.01); *F02F 2200/00* (2013.01)

(58) Field of Classification Search
CPC .... F16J 9/26; F02F 3/10; F02F 3/0084; F02F 3/00; F02F 7/0085; F16C 33/208; F16C 2240/48; B05D 5/08
See application file for complete search history.

(56) References Cited

U.S. PATENT DOCUMENTS 5,486,299 A * 1/1996 Fuwa ..... C10M 169/04 508/106
8,082,899 B2 * 12/2011 Kuroda ..... C09D 163/00 123/193.6
8,220,433 B2 * 7/2012 Sasaki ..... C10M 111/04 123/193.6
8,408,116 B2 * 4/2013 Fussner ..... F02F 3/105 29/888.048
8,789,509 B2 * 7/2014 Sasaki ..... C10M 111/04 123/193.6
9,255,545 B2 2/2016 Rehl et al.
(Continued)

FOREIGN PATENT DOCUMENTS

DE 102009001715 A1 9/2010
DE 102012207819 A1 11/2013
(Continued)

OTHER PUBLICATIONS

English abstract for DE-102009001715.
English abstract for DE-102012207819.
German Search Report for DE-102016207592.6, dated Jan. 31, 2017.

*Primary Examiner* — Long T Tran
(74) *Attorney, Agent, or Firm* — Fishman Stewart PLLC

(57) ABSTRACT

A piston for an internal combustion engine may include a shaft. A dual-layer coating with an inner layer and an outer layer may be applied to the shaft. The inner layer may include organic binders and solid lubricants. The inner layer may also include hard material particles of at least one of tungsten disulphide ($WS_2$), tungsten carbide (WC), silicon carbide (SiC), and aluminum oxide ($Al_2O_3$). The outer layer may include inorganic binders, may be air-hardening, and may have a lower wear resistance than the inner layer.

19 Claims, 1 Drawing Sheet

(56) References Cited

U.S. PATENT DOCUMENTS

| | | | | |
|---|---|---|---|---|
| 9,285,032 | B2 * | 3/2016 | Sasaki | F02F 5/00 |
| 2008/0159671 | A1 | 7/2008 | Leonardelli | |
| 2010/0236516 | A1 * | 9/2010 | Sasaki | C10M 111/04<br>123/193.6 |
| 2012/0222646 | A1 * | 9/2012 | Sasaki | C10M 111/04<br>123/193.6 |
| 2015/0184612 | A1 * | 7/2015 | Takada | F02F 3/10<br>123/193.6 |
| 2016/0084308 | A1 * | 3/2016 | Gorges | F16C 33/102<br>384/430 |

FOREIGN PATENT DOCUMENTS

| | | | |
|---|---|---|---|
| EP | 1892429 | A2 | 2/2008 |
| EP | 1894987 | A1 | 3/2008 |
| WO | WO-2012/041769 | A2 | 4/2012 |

* cited by examiner

PISTON FOR AN INTERNAL COMBUSTION ENGINE WITH A SHAFT

CROSS-REFERENCE TO RELATED APPLICATIONS

This application claims priority to German Patent Application No. DE 10 2016 207 592.6, filed on May 3, 2016, the contents of which are incorporated by reference in its entirety.

TECHNICAL FIELD

The present invention relates to a piston for an internal combustion engine with a shaft. The invention also relates to an internal combustion engine with at least one such piston and a method for applying a coating to the shaft of one such piston.

BACKGROUND

Coatings for ensuring run-in and emergency operation properties having a functional/gradual structure have been known for some time, and the composition of such coatings must strike a balance between friction-minimizing and wear-resistance properties. For this reason, highly wear-resistant components such as connecting rods in particular have carbon fibre-reinforced coatings, for example with a high roughness value, but this can be disadvantageous with respect to process monitoring. In addition, such hard carbon fibers have an abrasive effect on aluminium counterfaces, which can lead to undesirable polishing effects or the formation of grooves.

WO 2012/041769 A2 discloses a generic piston for an internal combustion engine having a shaft coating with a wear-resistant inner layer composed of a polymer matrix with ceramic particles dispersed therein, aramid fibers and/or carbon fibers and an outer layer composed of a polymer matrix with solid lubricants dispersed therein. The purpose is to provide a functional inner layer that is applied directly to the surface of the piston, as well as a wear-resistant outer layer (substrate layer) by means of which run-in behaviour and in particular scuff resistance are to be improved. The friction-minimizing coating is also intended to allow reduction of fuel consumption and $CO_2$ emissions during operation of the internal combustion engine.

A further generic piston with a dual-layer shaft coating is known from EP 1 894 987 A1.

However, a drawback of the pistons known from the prior art is that production of the coatings is relatively energy-intensive.

SUMMARY

The present invention is therefore intended to provide an improved or at least alternative embodiment for a piston of the generic type which is characterized in particular by more economical production.

This problem is solved according to the invention by the subject matter of the independent claims. Advantageous embodiments are the subject matter of the dependent claims.

The present invention is based on the general idea of applying a dual-layer coating having an inner layer and an outer layer to a shaft of a piston of an internal combustion engine, with the outer layer being applied to the inner layer for example by spraying or brushing, i.e. in liquid form, and being configured such that it can dry or harden in the air, allowing significant conservation of energy compared to the coatings known from the prior art. In addition, the outer layer shows sharply reduced wear resistance compared to the inner layer, making it possible to achieve clearance in highly stressed areas after a very brief run-in phase of only one to six seconds and thus to sharply reduce friction losses. The inner layer of the dual-layer coating according to the invention comprises organic binders and solid lubricants, as well as hard material particles of tungsten disulphide ($WS_2$), tungsten carbide (WC), silicon carbide (SiC) and/or aluminium oxide ($Al_2O_3$). In contrast, the outer layer comprises inorganic binders, and because of its sharply higher wear propensity compared to the inner layer, it is suitable for allowing rapid running in of the piston. The configuration of the outer layers with inorganic binders in particular allows air drying, which considerably reduces the process costs of manufacturing the piston according to the invention. After the run-in phase, the dual-layer coating according to the invention is also advantageous in that the easily-worn outer layer, particularly in highly-stressed areas, is at least partially worn away and is much smoother at the surface or towards the interface with the inner layer, allowing a greater contact surface to be achieved between the piston shaft and the cylinder.

In an advantageous improvement of the solution according to the invention, the organic binders of the inner layer are selected from the following group: polyamides (PAI), polyether ketones (PEK), polyether ether ketones (PEEK) and/or polyaryl ether ketones (PAEK), silicone-epoxides, polybenzimidazole (PBI), or a blend of PAI and silicone resins or further blends with PAI systems.

Examples of polyamides are linear polymers with regularly repeating amide bonds along the main chain. These are characterized in particular by high strength, high stiffness and high toughness and also show favourable stability with respect to chemicals and good processability. Polyamides react to moisture with reversible water absorption or release. Polyether ketones are polymers in the molecular backbone of which alternating ketone and ether functional groups are present. The most common types are polyether ether ketones (PEEK), which are highly temperature-resistant thermoplastic resins, and polyaryl ether ketones (PAEK). PEK, PEEK and PAEK also possess high resistance to organic and inorganic chemicals.

In an advantageous improvement of the solution according to the invention, the solid lubricants of the inner layer comprise molybdenum disulphide ($MoS_2$) and/or graphite. Molybdenum disulphide is a greyish-black crystalline sulphite of the chemical element molybdenum having a particle diameter of 0.5 μm to 5 μm, and it is particularly suitable as a technical dry lubricant. In particular, such dry lubricants improve the emergency operation properties of the piston in the event of a shutdown in lubricating oil supply. Graphite also provides such dry lubricant properties, thus ensuring the emergency operation properties of the piston equipped with this coating.

Purely theoretically, of course, the outer layer of such solid lubricants, which has a higher wear propensity than the inner layer, may also comprise molybdenum disulphide and/or graphite.

In a further advantageous embodiment of the solution according to the invention, the outer layer is temperature-resistant in a temperature range of −180° C. to +450° C. This embodiment makes it possible to ensure that the outer layer, particularly during running in or the running-in phase, is not negatively affected by the temperatures generated. Moreover, the temperatures generated during operation of the internal combustion engine in the area of the coating on the piston shaft do not exceed 450° C., so that there is also no negative effect in this area.

The present invention is further based on the general idea of providing a method for applying the above-described dual-layer coating to a shaft of the piston in which the inner layer is first applied to the shaft of the piston, for example by means of common standard methods such as silk-screen printing in particular. The outer layer is then applied in liquid form to the shaft of the piston, particularly sprayed on, brushed on, or applied by the pad printing method.

Because of the inorganic binder in the outer layer, this layer can now dry in the air, providing a considerable advantage with respect to the energy required to produce the coating, and the second layer of the coating does not have to be hardened in an energy-intensive manner, for example by heat or infrared radiation.

Further important features and advantages of the invention are given in the subordinate claims, the drawings, and the accompanying description of the figures with reference to the drawings.

It is to be understood that the above-mentioned features, and those to be mentioned below, are usable not only in the respective combinations described, but also in other combinations or alone, without departing from the scope of the present invention.

Preferred illustrative embodiments of the invention are shown in the drawings and will be described in further detail below, with identical reference symbols referring to identical or functionally identical components.

DETAILED DESCRIPTION

Figure 1:
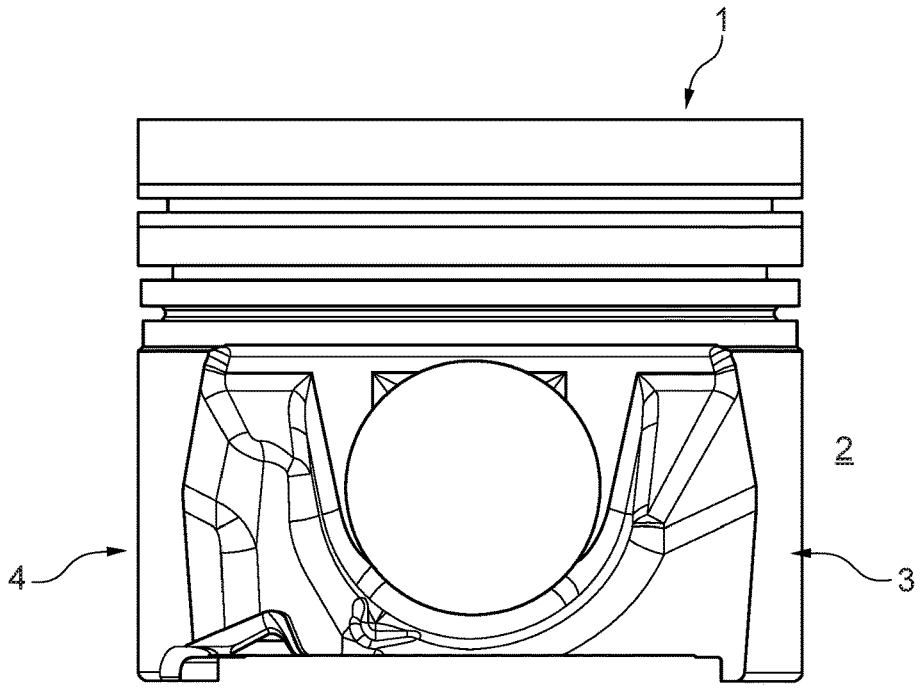
FIG. 1 shows a side view of a piston according to the invention with a dual-layer coating according to the invention on a shaft.
Figure 2:
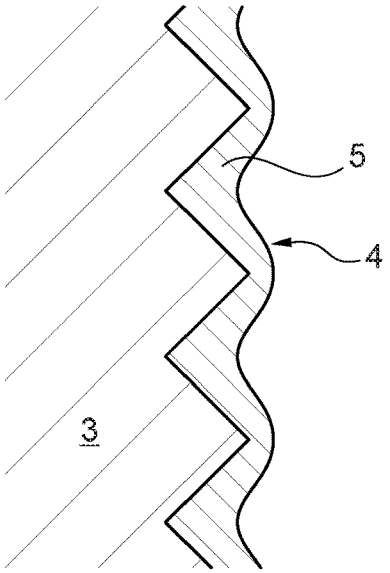
FIG. 2 shows a sectional view through the piston in the area of the coating after application of the inner layer.
Figure 3:
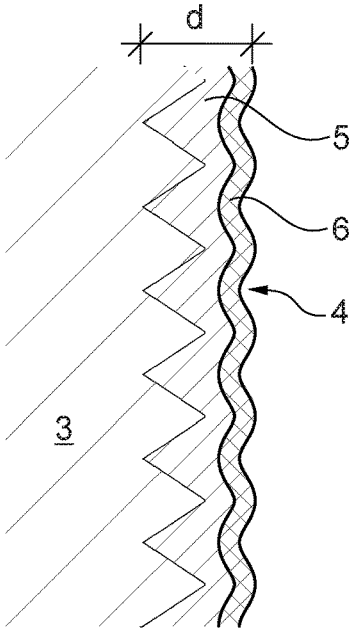
FIG. 3 shows a view like that of FIG. 2, but after application of the outer layer.

In accordance with FIGS. 1 to 3, a piston according to the invention 1 for an internal combustion engine 2 has a shaft 3. According to the invention, a dual-layer coating 4 (also cf. FIG. 3) with an inner layer 5 and an outer layer 6 is now applied to the shaft 3. The inner layer 5 comprises both organic binders and solid lubricants, such as molybdenum disulphide ($MoS_2$) and/or graphite, and thus possesses the dry lubrication properties required for reliable operation, which ensures emergency operation characteristics for at least a certain period of time in the event of a shutdown in the lubricant supply system. Moreover, the inner layer 5 also comprises hard material particles composed for example of tungsten disulphide ($WS_2$), tungsten carbide (WC), silicon carbide (SiC) and/or aluminium oxide ($Al_2O_3$), which sharply increase the wear resistance of the inner layer 5. Tungsten sulphides are chemical compounds from the group of the tungsten compounds and sulphides. Tungsten carbide is a non-oxide ceramic or an intermediate crystal phase formed from the elements tungsten and carbon. In this case, tungsten carbides are used in particular for highly-stressed components, but can also be used in particle form to sharply improve the wear resistance of a coating, here the inner layer 5. The outer layer 6 comprises inorganic binders, is air-hardening, and shows sharply reduced wear resistance compared to the inner layer 5, making it possible to achieve a significantly reduced run-in phase of the piston 1 in the internal combustion engine 2 of only up to six hours. In this run-in phase, the outer layer 6 is already worn away to the extent that it provides a sharply larger contact surface between the shaft 3 and a cylinder wall, particularly in highly-stressed areas, thus in particular helping to sharply reduce performance losses.

In this case, the organic binders of the inner layer 5 can be selected from the following group: polyamides (PAI), polyether ketones (PEK), polyether ether ketones (PEEK) and/or polyaryl ether ketones (PAEK), silicone-epoxides, polybenzimidazole (PBI), or a blend of PAI and silicone resins or further blends with PAI systems. Even this non-exhaustive list gives an idea of the wide-ranging possibilities provided for the organic binder of the inner layer 5, inasmuch as these have high strength, high toughness, and high resistance.

The solid lubricants comprise particles, such as molybdenum disulphide particles or graphite particles, with a diameter of 0.5 μm to 5 μm. By means of the microfine solid lubricant particles, the dry lubrication properties and thus the emergency operation properties in particular can be sharply increased. In contrast, the hard material particles of the inner layer 5 have a particle size of 500 nm to 1,000 nm and are thus much smaller than the particles of the solid lubricants. The small particle size of the hard material particles makes it possible to sharply improve the strength properties and thus also the wear resistance of the inner layer 5.

The coating 4 is produced as follows:

The inner layer 5 is first applied to the shaft 3 of the piston 1, for example by silk-screen printing, with subsequent hardening in a convection oven or by means of infrared radiation. The outer layer 6 is then applied in initially liquid form to the shaft 3 of the piston 1, particularly by spraying or brushing on, or by the pad printing method, which constitutes the most attractive solution. Because of the special configuration of the outer layer 6, this layer can now harden in air without requiring additional input of energy. In particular, the air-hardening outer layer 6 allows process costs to be substantially reduced.

In the subsequent run-in operation of the internal combustion engine 2, the outer layer 6 is worn away relatively quickly because of its low wear resistance, thus making it possible to achieve clearance between the shaft 3 on the one hand and the cylinder wall on the other, which has a positive effect on frictional performance losses. After the at least partial wearing away of the outer layer 6, the inner layer 5 takes over the task of increasing the wear resistance and also ensuring the emergency operation properties by means of the solid lubricants embedded therein, such as molybdenum disulphide or graphite. In this case, a thickness d of the coating 4 is ordinarily 5 μm to 30 μm, and preferably approx. 15 μm.

The dual-layer coating 4 according to the invention thus makes it possible to more gently apply a wear-resistant layer with a sharply reduced energy requirement, and thus in a cost-reducing and resource-saving manner.

The invention claimed is:

1. A piston for an internal combustion engine, comprising a shaft, wherein:

a dual-layer coating with an inner layer and an outer layer is applied to the shaft;

the inner layer includes organic binders and solid lubricants;

the inner layer includes hard material particles of at least one of tungsten disulphide ($WS_2$), tungsten carbide (WC), silicon carbide (SiC), and aluminium oxide ($Al_2O_3$); and the outer layer includes inorganic binders, is air-hardening, and has a lower wear resistance than the inner layer;

wherein the hard material particles have a particle size of 500 nm to 1,000 nm.

2. The piston according to claim 1, wherein the organic binders of the inner layer include one of polyamides (PAI), polyether ketones (PEK), polyether ether ketones (PEEK), polyaryl ether ketones (PAEK), silicone-epoxides, polybenzimidazole (PBI), or a blend of PAI and one of silicone resins and PAI systems.

3. The piston according to claim 1, wherein the solid lubricants are at least one of molybdenum disulphide ($MoS_2$) and graphite.

4. The piston according to claim 3, wherein the solid lubricants include particles with a diameter ranging from 0.5 μm to 5 μm.

5. The piston according to claim 1, wherein the outer layer includes lubricants.

6. The piston according to claim 5, wherein the lubricants of the outer layer are solid lubricants composed of one of molybdenum disulphide ($MoS_2$) and graphite.

7. The piston according to claim 1, wherein a thickness of the coating is between 5 μm and 30 μm.

8. The piston according to claim 7, wherein a thickness of the coating is 15 μm.

9. The piston according to claim 1, wherein the outer layer is temperature resistant in a temperature range of −180° C. to +450° C.

10. An internal combustion engine comprising at least one piston having a shaft, wherein:

a dual-layer coating with an inner layer and an outer layer is applied to the shaft;

the inner layer includes organic binders and solid lubricants;

the inner layer includes hard material particles of at least one of tungsten disulphide ($WS_2$), tungsten carbide (WC), silicon carbide (SiC), and aluminium oxide ($Al_2O_3$); and the outer layer includes inorganic binders, is air-hardening, and has a lower wear resistance than the inner layer;

wherein the hard material particles have a particle size of 500 nm to 1,000 nm.

11. The internal combustion engine according to claim 10, wherein the organic binders of the inner layer include one of polyamides (PAI), polyether ketones (PEK), polyether ether ketones (PEEK), polyaryl ether ketones (PAEK), silicone-epoxides, polybenzimidazole (PBI), or a blend of PAI and one of silicone resins and PAI systems.

12. The internal combustion engine according to claim 10, wherein the solid lubricants are at least one of molybdenum disulphide ($MoS_2$) and graphite.

13. The internal combustion engine according to claim 12, wherein the solid lubricants include particles with a diameter ranging from 0.5 μm to 5 μm.

14. The internal combustion engine according to claim 10, wherein the hard material particles have a particle size of 500 nm to 1,000 nm.

15. The internal combustion engine according to claim 10, wherein the outer layer includes lubricants.

16. The internal combustion engine according to claim 15, wherein the lubricants of the outer layer are solid lubricants composed of one of molybdenum disulphide ($MoS_2$) and graphite.

17. The internal combustion engine according to claim 10, wherein a thickness of the coating is between 5 μm and 30 μm.

18. The internal combustion engine according to claim 10, wherein the outer layer is temperature resistant in a temperature range of −180° C. to +450° C.

19. A method for applying a coating to a shaft of a piston, comprising:

applying an inner layer to the shaft;

applying an outer layer to the shaft in liquid form via one of spraying, brushing, and pad printing; and hardening the outer layer via air;

wherein the inner layer includes organic binders and solid lubricants;

wherein the inner layer includes hard material particles of at least one of tungsten disulphide ($WS_2$), tungsten carbide (WC), silicon carbide (SiC), and aluminium oxide ($Al_2O_3$); and wherein the outer layer includes inorganic binders, is air-hardening, and has a lower wear resistance than the inner layer; and wherein the hard material particles have a particle size of 500 nm to 1,000 nm.

* * * * *